US011318578B2

(12) United States Patent
Schneider et al.

(10) Patent No.: US 11,318,578 B2
(45) Date of Patent: May 3, 2022

(54) TOOL HOLDING FIXTURE AND DEVICE FOR POLISHING OF LENSES

(71) Applicant: Schneider GmbH & Co. KG, Fronhausen (DE)

(72) Inventors: Gunter Schneider, Marburg (DE); Klaus Hofmann, Wehrheim (DE); Helwig Buchenauer, Dautphetal-Buchenau (DE)

(73) Assignee: SCHNEIDER GMBH & CO. KG, Fronhausen (DE)

( * ) Notice: Subject to any disclaimer, the term of this patent is extended or adjusted under 35 U.S.C. 154(b) by 966 days.

(21) Appl. No.: 16/011,722

(22) Filed: Jun. 19, 2018

(65) Prior Publication Data

US 2018/0361534 A1 Dec. 20, 2018

(30) Foreign Application Priority Data

Jun. 19, 2017 (EP) ..... 17020258
Oct. 11, 2017 (EP) ..... 17020464

(51) Int. Cl.

| | |
|---|---|
| ***B24D 9/10*** | (2006.01) |
| ***B24B 45/00*** | (2006.01) |
| ***B24B 13/01*** | (2006.01) |
| *B24B 13/00* | (2006.01) |

(52) U.S. Cl.
CPC ..... *B24B 45/006* (2013.01); *B24B 13/012* (2013.01); *B24B 13/00* (2013.01)

(58) Field of Classification Search
CPC ..... B24B 45/006; B24B 13/012; B24B 13/00; B24B 13/02; B24B 13/01
USPC ..... 451/285, 384, 390, 494
See application file for complete search history.

(56) References Cited

U.S. PATENT DOCUMENTS

| | | | | |
|---|---|---|---|---|
| 5,421,770 | A * | 6/1995 | Bobst | B24B 13/005 451/162 |
| 6,089,963 | A | 7/2000 | Wiand et al. | |
| 7,066,794 | B2 * | 6/2006 | Granziera | B24B 13/012 451/158 |
| 7,278,908 | B2 | 10/2007 | Urban et al. | |
| 7,387,479 | B1 * | 6/2008 | Lee | B23B 31/1071 279/75 |
| 2001/0041650 | A1 | 11/2001 | Senga et al. | |
| 2006/0199481 | A1 * | 9/2006 | Urban | B24B 13/012 451/285 |
| 2010/0219594 | A1 * | 9/2010 | Nash | B25B 23/0035 279/77 |
| 2016/0008944 | A1 | 1/2016 | Chen et al. | |
| 2017/0246729 | A1 | 8/2017 | Philipps et al. | |
| 2019/0126432 | A1 * | 5/2019 | Wallendorf | B24B 13/00 |

FOREIGN PATENT DOCUMENTS

| | | |
|---|---|---|
| CN | 1947942 A | 4/2007 |
| DE | 10 2004 062 319 B3 | 3/2006 |

* cited by examiner

*Primary Examiner* — Joseph J Hail
*Assistant Examiner* — Shantese L McDonald
(74) *Attorney, Agent, or Firm* — David S. Safran; Roberts Calderon Safran & Cole, P.C.

(57) ABSTRACT

A tool holding fixture for a tool drive and a device for polishing of optical workpieces, the tool holding fixture being coupled by a magnet and by quick connections to the tool drive and forming a preassembled unit with a tiltable tool holder and assigned bearing part together with a bellows.

26 Claims, 6 Drawing Sheets

TOOL HOLDING FIXTURE AND DEVICE FOR POLISHING OF LENSES

BACKGROUND OF THE INVENTION

Field of the Invention

This invention relates to a tool holding fixture for a tool drive for polishing of optical workpieces, in particular eyeglass lenses, by means of a rotatable tool and a device for polishing of optical workpieces, in particular optical lenses or eyeglass lenses.

Description of Related Art

German Patent DE 10 2004 062 319 B3 and U.S. patent application publication 2017/0246729 A1 each disclose a device for polishing of optical workpieces, in particular lenses, by means of a rotatable tool. The device has a tool drive and a tool holding fixture. The tool holding fixture has a tool holder which is tiltably supported via a ball head. The tool holder holds the interchangeable polishing tool. Furthermore the tool holding fixture has a bellows which is assigned to the tool holder and which follows an axial adjustment of the tool holder. Changing of the bellows and of the ball head bearing in case of wear is difficult due to the often tight space conditions in the working space.

U.S. Pat. No. 7,066,794 B2 discloses a holding fixture for a membrane for finishing of optically active surfaces on eyeglass lenses. The holding fixture has a base body which can be releasably attached to a tool spindle of a processing machine. The membrane is tiltably attached to the base body via a connected bellows. The membrane can only be replaced together with the bellows. The bellows is held on the base body via a tightly screwed retaining ring so that replacement is complex. In order to apply a machining pressure during machining of the optically active surface the bellows is supplied with a pressure medium.

U.S. Pat. No. 7,278,908 B2 discloses a similar holding fixture for finishing of optically active surfaces on eyeglass lenses. The holding fixture has a tiltable mounting section on which a polishing pad can be seated. By supplying a pressure medium the mounting section and the polishing pad can be axially advanced or adjusted. The polishing pad is held in a torsion-resistant manner by the mounting section and is held axially between the mounting section and the surface to be treated solely by the advancement mechanism.

SUMMARY OF THE INVENTION

The object of this invention is to devise a tool holding fixture for a tool drive for polishing of optical workpieces as well as a device for polishing of optical workpieces, wherein very simple fastening and changing of the tool holding fixture, in particular even with limited space for movement or directly in a working space, is enabled.

This object is achieved by a tool holding fixture or a device as described herein.

According to one aspect of this invention the tool holding fixture is embodied preferably for magnetic coupling to or holding on a tool drive or an axially adjustable positioning element of the tool drive. This allows very simple and prompt or quick mounting and dismounting, in particular without using tools.

In particular the tool holding fixture or a tool holder or bearing part of the tool holding fixture is coupled to or held magnetically on the tool drive or its positioning element, preferably in the axial direction. This allows very simple holding and positioning, in particular in the axial direction.

Preferably a proposed tool drive has an axially adjustable positioning element, in particular for axial adjustment or advancement or application of a pressure to the workpiece which is to be processed or machined, and/or the tool holding fixture is embodied for mechanical coupling to one such positioning element. Advantageously in this way a defined adjustment, pressure application and/or positioning of the tool can be achieved.

According to another aspect of this invention which can also be independently implemented, the tool holding fixture is or can be interchangeably attached or fastened to the tool drive by means of a quick connection and/or the tool holding fixture has for fastening to the tool drive in a tool-free manner quick connection elements for the formation of one or more quick connections. This allows a very simple and prompt or quick mounting and dismounting in particular without tools.

Preferably the tool holding fixture is or can be connected both to the tool drive, in particular a head of the tool drive, by means of the quick connection and also to the axially adjustable positioning element of the tool drive, in particular via the magnetic coupling. This allows especially stable holding and/or positioning of the tool holding fixture.

Preferably the tool is slipped, plugged, clipped, snapped or latched axially onto the tool holding fixture or its tool holder and is withdrawn axially from it for changing. This enables very simple mounting and dismounting or changing of the tool.

Preferably the tool is held such that it can be fastened or attached to the tool holding fixture or the tool holder and/or detached from it without tools, in particular it can be released and/or withdrawn from the tool holding fixture or the tool holder by application of an axial force.

Preferably the tool is held axially and/or radially or in a torsion-resistant or rotatably fixed manner, especially preferably both axially and also radially or in a torsion-resistant or rotatably fixed manner, and/or by latching on the tool holding fixture or its tool holder, and/or the tool holding fixture or the tool holder is embodied for this purpose.

Especially preferably the magnetic coupling of the tool holder to the tool drive and/or the axial retaining force of the quick connection is greater than the axial force for releasing the tool from the tool holder, in particular by more than 50%, especially preferably by more than 100%.

Especially preferably, the tool can therefore on the one hand be attached or fastened to the tool holding fixture and/or released from it without tools and/or on the other hand the tool holding fixture can be attached or fastened to the tool drive and/or can be released from it without tools. Preferably, both the tool and the tool holding fixture can be released or detached by axially withdrawing or applying an axial force, for the release of the tool preferably a smaller force being applicable so that the tool can be changed with the tool holding fixture still attached to the tool drive. Advantageously in this way very simple and prompt or quick mounting and dismounting is enabled, in which alternatively only the tool which is to be changed more frequently or the entire tool holding fixture can be changed.

According to one especially preferred aspect of this invention which can also be independently implemented, the tool holding fixture or an assembly or structural unit or module formed by it has one, several or all wear-prone parts which are normally replaced for maintenance or servicing in a tool drive or a device for polishing of optical workpieces with the tool drive and the interchangeable tool holding fixture. A wear-prone part in the proposed sense is in particular a tilting bearing of a tool holder, such as a tool holder and a bearing part which tiltably holds the tool holder, and/or a bellows. Thus, in the case of wear very simple and prompt or quick changing or replacement in particular without tools is enabled.

According to another aspect of this invention which can also be independently implemented, the tool holding fixture is embodied in particular as a preassembled unit, module or assembly with a tiltable tool holder and a bearing part which tiltably holds the tool holder. This allows very simple and prompt or quick mounting and dismounting in particular without tools.

Preferably the assembly or a bearing arrangement which comprises the tool holder and the bearing part is made on the one hand to hold the tool in particular by latching and/or axially and/or releasably without tools, and/or on the other hand to implement in particular magnetic coupling or holding on the positioning element of the tool drive. In particular, the tool is held indirectly via the assembly or the bearing arrangement on the positioning element, in particular in an axially adjustable manner.

Especially preferably, the tool holding fixture comprises the tiltable tool holder and preferably the bearing part which tiltably holds the tool holder and optionally a bellows assigned to the tool holder and/or a connecting part in particular for fastening the bellows on the tool drive and thus forms in particular a preassembled unit, module or assembly. Thus the changing of components which must be changed more often due to wear is easily and promptly or quickly enabled since the tool holding fixture can be very easily and promptly or quickly changed, in particular tool-free, i.e. without using tools, due to the magnetic holding and/or quick connection.

The aforementioned and following aspects and features of this invention can be combined in any manner, but also can be implemented independently of one another.

Further aspects, features, advantages and properties of this invention will become apparent from the following description of a preferred embodiment using the drawings.

DETAILED DESCRIPTION OF THE INVENTION

Figure 1:
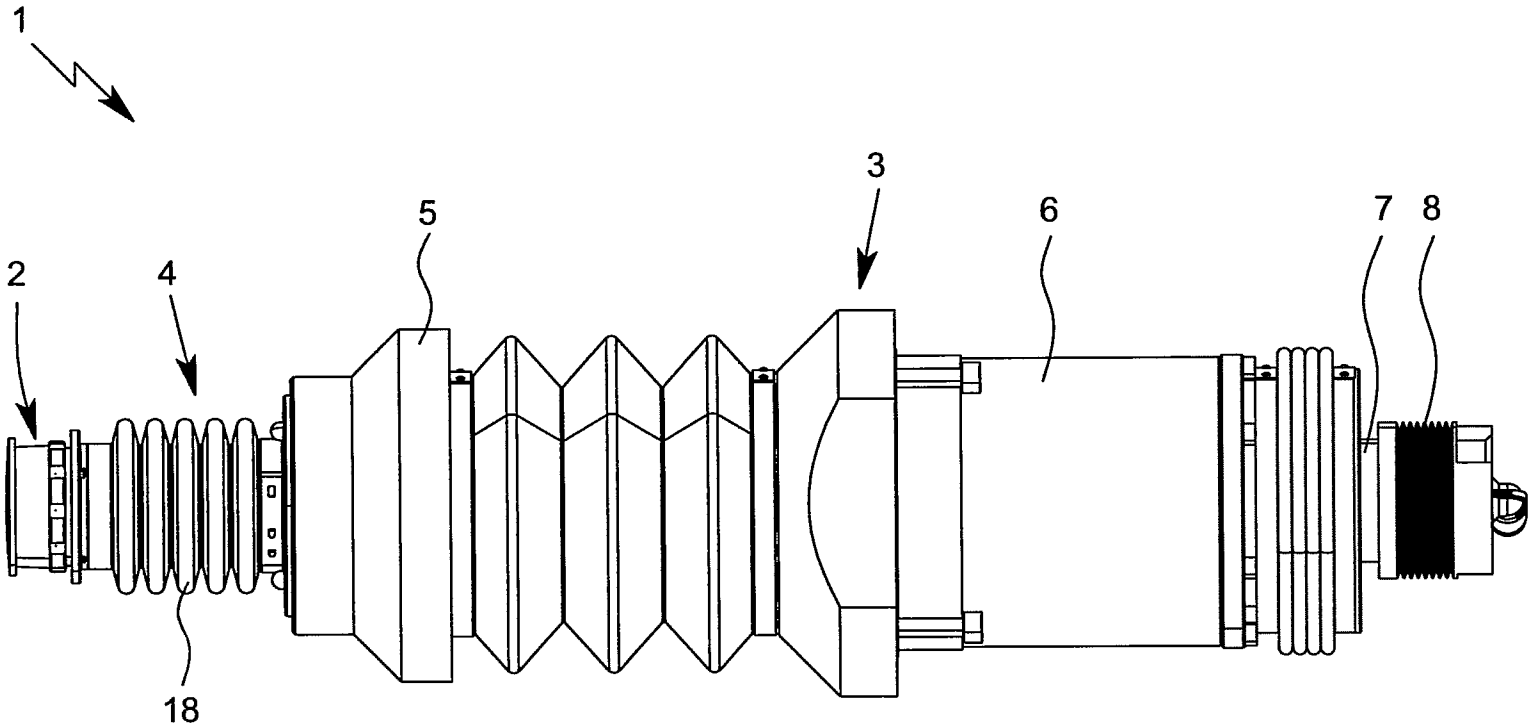
FIG. 1 shows a schematic side view of a proposed device with a tool for polishing an optical workpiece in an axially extended state.

FIG. 1 shows in a side view a proposed device 1 for polishing of an optical workpiece which is not shown, in particular an optical lens, such as an eyeglass lens, a mirror or the like, the workpiece especially preferably being made of plastic and/or glass, by means of a rotatable tool 2. The device 1 is also called a polishing spindle.

The device 1 has a tool drive 3 and a tool holding fixture 4.

The tool 2 is or can be releasably attached or fastened to the tool holding fixture 4. In particular the tool 2 is slipped, plugged, clipped, snapped or latched axially onto the tool holding fixture 4 and/or can be released again from the tool holding fixture 4 by axial withdrawal.

The tool holding fixture 4 is embodied or implemented preferably as a pre-assembled structural unit, module or assembly which can be changed very easily and/or promptly or quickly and in particular tool-free, i.e., without using tools.

The tool drive 3 preferably has a rotatable head 5 to which the tool holding fixture 4 is or can be attached or fastened.

The tool drive 3 preferably has a housing 6 and a shaft 7 which is rotationally mounted therein. The shaft 7 which is preferably made in several parts is coupled in a torsion-resistant or rotatably fixed manner to the head 5 and in the illustrated example for rotary driving has preferably a belt pulley 8 or other drive element. However it is also possible for a drive motor to be integrated for example into the tool drive 3 or coupled to the shaft 7 in some other way.

The head 5 and thus the tool holding fixture 4 are preferably axially adjustable. For this purpose in the illustrated example the shaft 7 together with the head 5 can preferably be adjusted axially relative to the housing 6. This is used in particular for a first or rough adjustment, advancement or infeed of the tool 2 to a workpiece (not shown) which is to be treated, machined or processed.

Figure 2:
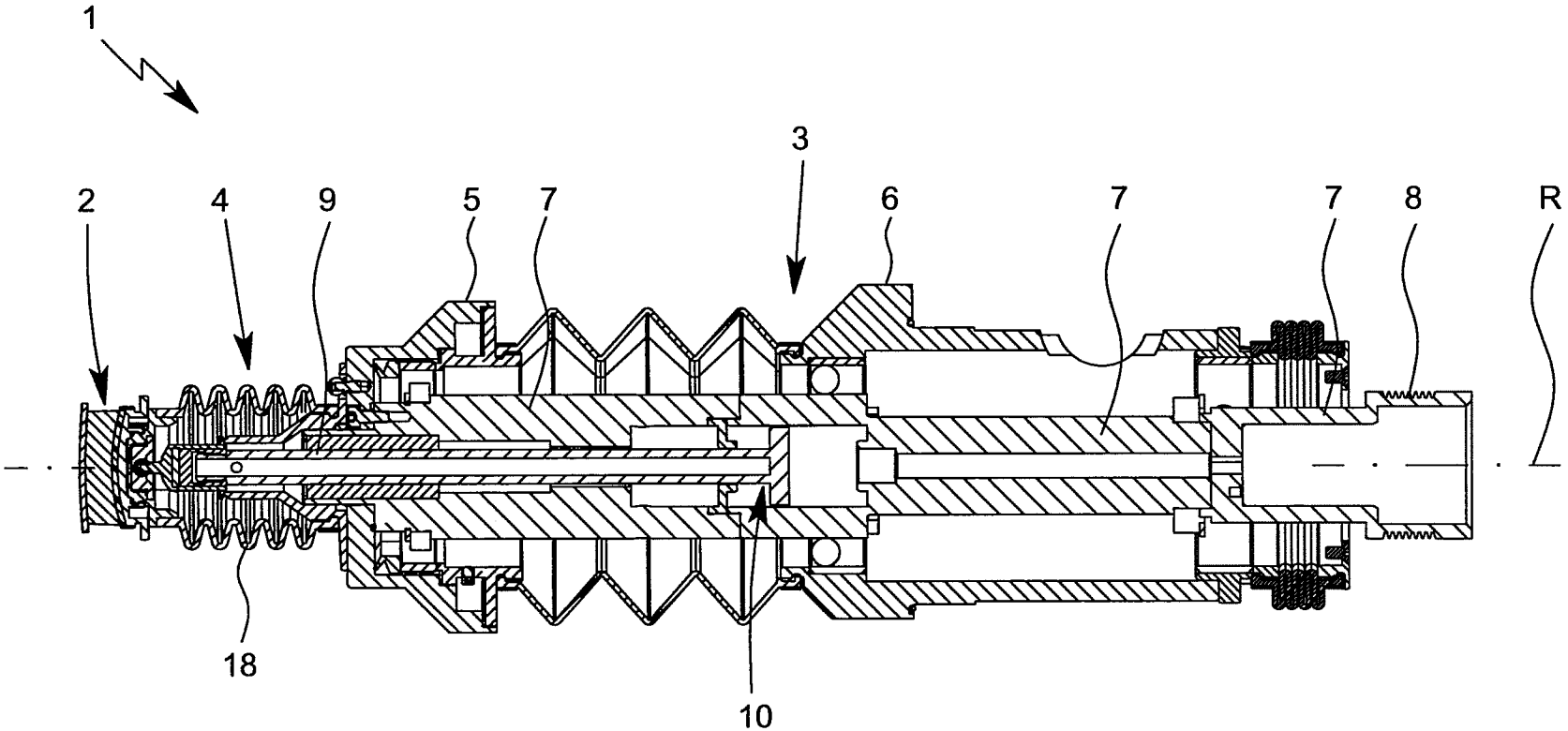
FIG. 2 shows a schematic longitudinal section of the device.

FIG. 2 shows the device 1 in a schematic longitudinal section.

The tool drive 3 preferably has a positioning element 9 and in particular an assigned positioning drive 10.

The positioning element 9, in particular by means of the positioning drive 10, is axially movable, in particular can be displaced or adjusted in an axially relative manner and/or very easily to the shaft 7 or the head 5.

The axial adjustability of the positioning element 9 is used especially for axial pre-tensioning and/or continuous contact of the tool 2 with the workpiece to be machined or processed. In particular the positioning element 9 is pre-tensioned or moved forward in the extended position shown in FIG. 2, especially preferably by the positioning drive 10 or in some other way.

Especially preferably the positioning element 9 is moved or pretensioned into the extended position or axially forward or (further) beyond the head 5 or towards the workpiece by pneumatic pressurization or action on the positioning drive 10.

The tool 2, the tool holding fixture 4, the head 5, the shaft 7 and/or the belt pulley 8 and optionally the positioning element 9 can be rotated around the longitudinal axis and/or axis R of rotation. The rotation around this axis R takes place during processing or machining by the rotary drive (not shown) which acts here on the belt pulley 8.

In the illustrated example the positioning element 9 rotates preferably together with the shaft 7 and/or the head 5. Optionally or preferably the positioning element 9 can be turned or rotated relative to the head 5 and/or to the shaft 7 and/or is not used to transfer a torque to the tool 2.

Figure 3:
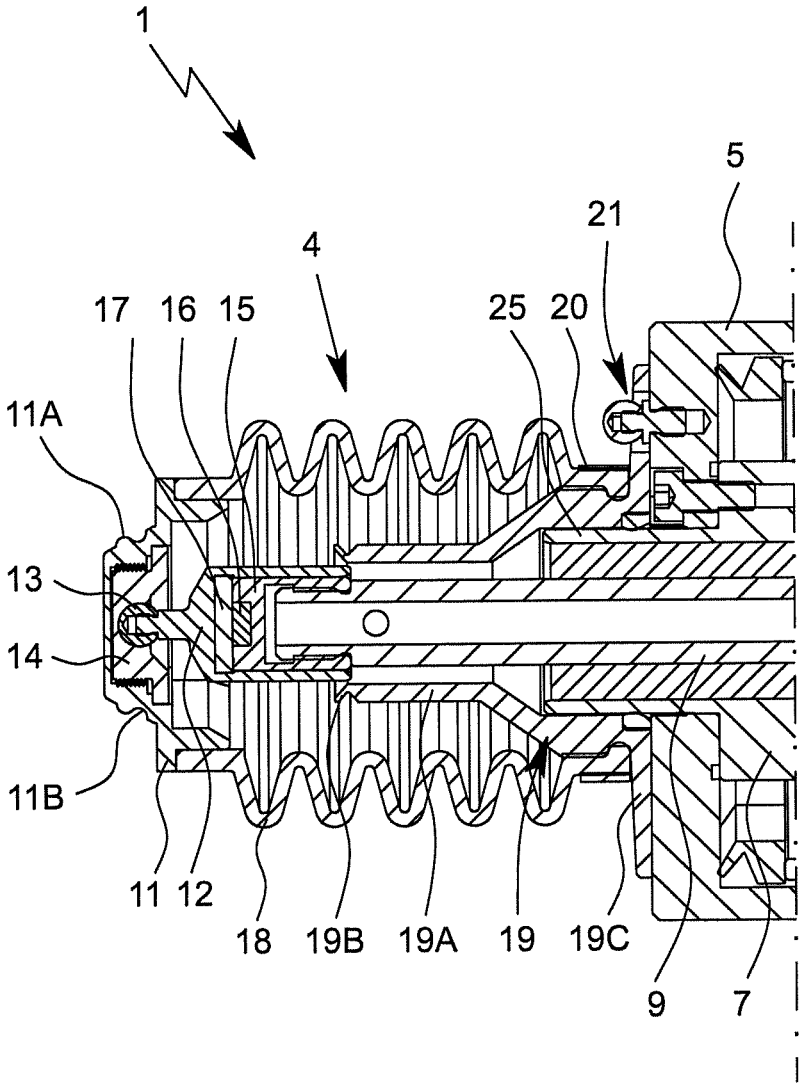
FIG. 3 shows an enlargement of an extract from FIG. 2 in the region of a tool holding fixture without the tool.

FIG. 3 shows in an extract enlargement from FIG. 2 the front or tool-side region of the device 1, now without the tool 2.

The tool holding fixture 4 has a preferably tiltable tool holder 11 for holding of the interchangeable or replaceable tool 2.

Furthermore the tool holding fixture 4 preferably has a bearing part 12 which tiltably holds the tool holder 11. In the illustrated example the bearing part 12 preferably holds an especially spherical bearing head or bearing portion 13 on which a bearing element 14 which bears the tool holder 11 tiltably sits. This type of bearing does not transfer torque. However, other structural solutions are also possible here.

Preferably the tool holder 11 is supported in the manner of a ball head bearing on the bearing part 12 and/or with a tilting capacity relative to it.

Preferably the tool holding fixture 4, the tool holder 11 and/or the bearing part 12 is mechanically and/or magnetically coupled to the tool drive 3 and/or the positioning element 9 or is held in particular axially thereon. In the illustrated example the positioning element 9 on its free end preferably has a holding part 15 for holding of the bearing part 12. In particular, the bearing part 12 can be attached or slipped onto the holding part 15.

The holding part 15 is preferably connected inseparably, permanently or firmly to the positioning element 9.

Preferably an assembly, structural unit or module or a bearing arrangement which comprises the tool holder 11 and the bearing part 12 is embodied to hold the tool 2, in particular tiltably, on the tool drive 3 or its positioning element 9. The assembly, unit or module or the bearing arrangement is thus embodied in particular to on the one hand hold the tool 2 and on the other hand to form a preferably mechanical or magnetic coupling to the tool drive 3, positioning element 9 and/or holding part 15.

To implement the magnetic coupling or holding, in the illustrated example the tool drive 3, its positioning element 9 and/or its holding part 15 preferably has a magnet 16 or alternatively a magnetizable material, and the tool holding fixture 4, the tool holder 11 and/or the bearing part 12 then correspondingly thereto has a holding element 17 of a magnetizable material or has a magnet.

In the illustrated example the magnet 16 is a permanent magnet and is preferably integrated, cast, glued or cemented into the holding part 15. However, other structural solutions are also possible.

In the illustrated example the holding element 17 is preferably integrated, inserted, glued, cemented, pressed or forced into the bearing part 12.

If necessary the magnet 16 and the holding element 17 can also be interchanged with one another, therefore the magnet 16 can be located on the bearing part 12 and conversely the holding element 17 on the holding part 15.

Preferably the magnet 16 and the holding element 17 interacting therewith are located or arranged on front surfaces pointing towards one another in the mounted state, in the illustrated example the surfaces of the holding part 15 and of the bearing part 12, and/or come to rest on one another in the mounted state. This is beneficial to strong magnetic coupling or large magnetic retaining forces.

The mechanical or magnetic coupling or retaining force is preferably more than 10 N, in particular more than 20 N, especially preferably more than 30 N and/or less than 150 N, preferably less than 100 N, in particular less than 80 N.

The magnetic coupling or holding acts in particular only in the axial direction. Alternatively or in addition it can however also act radially, for example in the manner of an annular magnet.

Preferably, the bearing part 12 can be slipped onto the positioning element 9 or the holding part 15 or connected to it in some other manner, in particular such that the bearing part 12 is radially held and/or guided. In the illustrated example this is facilitated and/or enabled by the preferably cap-like or pot-like construction and/or for example by providing retaining arms which are distributed radially over the periphery.

Here, it should be noted that the magnetic coupling or connection of the tool holding fixture 4 or its bearing part 12 on the positioning element 9 or its holding part 15 is preferred, but also other, in particular mechanical solutions are possible. For example the tool holding fixture 4 or the bearing part 12 and the positioning element 9 or the holding part 15 are or can be coupled or connected in particular axially by latching or the like. But preferably the tool holding fixture 4 or the bearing part 12 and the positioning element 9 or the holding part 15 can be connected to one another or released from one another without tools, in particular by applying an axial force.

The tool holding fixture 4 preferably has a bellows 18 and/or a connecting part 19.

The bellows 18 is assigned in particular to the tool holder 11 and attached or fastened to the tool holder 11 preferably with its tool-side end and is locked or secured optionally thereon with a fastening element which is not shown, like a ring, a clip or the like.

With its other end away from the tool the bellows 18 is preferably held on or attached or fastened to the tool drive 3, head 5 and/or connecting part 19. In the illustrated example the bellows 18 is fastened, locked, secured or held on the connecting part 19 preferably by means of a locking or securing element 20.

The connecting part 19 is or can be attached or fastened preferably in a torsion-resistant or rotatably fixed manner to the tool drive 3, head 5 and/or to the shaft 7.

The bellows 18 in the illustrated example is used preferably to transfer the torque or the rotation from the tool drive 3, from the shaft 7 and/or from the head 5 to the tool holder 11 and thus ultimately to the tool 2 which is rotating during polishing. However, other structural solutions are also possible. For example alternatively or in addition the positioning element 9 could also transfer a torque to the tool holder 11.

The bellows 18 can follow or bridge the axial adjustment, advancement or infeed of the positioning element 9 and thus of the tool holder 11 relative to the tool drive 3, the head 5 and/or to the shaft 7 and/or the bellows 18 is used to protect—in particular the tiltable bearing arrangement of the tool holder 11 and/or the axially movable bearing arrangement of the positioning element 9—against dirt accumulation, soiling or other effects.

The tool holding fixture 4 or assembly preferably has one, several or all wear-prone parts such as the tilting bearing arrangement or the tool holder 11, the bearing part 12, the bearing head 13, and/or the bearing element 14, and/or like the bellows 18 or other bearing elements, in particular all wear-prone parts of the device 1 or polishing spindle which are conventionally or typically to be replaced during maintenance or repair. This allows for very simple changing or replacement in particular in maintenance or repair.

Figure 4:
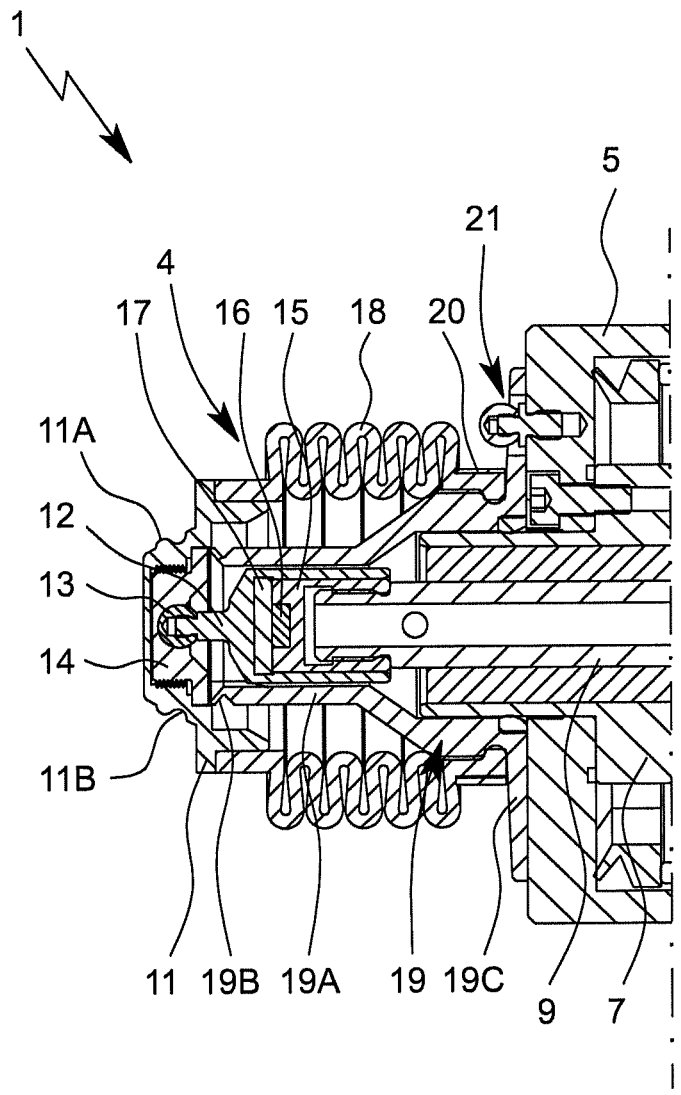
FIG. 4 shows an extract enlargement corresponding to FIG. 3 in the region of the tool holding fixture, but in an axially retracted state.

FIG. 4 shows in a section corresponding to FIG. 3 the tool holding fixture 4 or the tool holder 11 or the positioning element 9 in an axially retracted position. In this state the bellows 18 is axially compressed and/or the tool holder 11 is locked or supported or blocked against tilting.

In the illustrated example the connecting part 19 preferably has a support portion 19A which extends in particular axially in the direction of the tool holder 11 and/or surrounds the positioning element 9 and/or bearing part 12 in order to be able to adjoin or abut in the retreated state, in particular with its axial free end which can optionally be provided with a contact portion 19B, the side of the tool holder 11 and/or bearing element 14 facing away from the tool 2 and in this way to secure or block the tool holder 11 in the retracted state against tilting, as indicated in FIG. 4.

Preferably, tool changing takes place in the retracted state. This can be carried out in particular automatically by axial withdrawal of a used tool 2 and subsequent reseating or, clipping on or latching of a new, different or unused tool 2.

Especially preferably, the tool 2 is latched, clipped, plugged, snapped or slipped onto the tool holder 11 and/or connected in a torsion-resistant or rotatably-fixed manner to the tool holder 11.

Preferably, the tool 2 is held, attached or fastened, especially by latching, axially on the tool holder 11. Especially preferably the tool 2 can be released or attached without tools, in particular by axial withdrawal or application of an axial force.

The tool holder 11 preferably has projections 11A which can engage corresponding recesses 2A of the tool 2. Alternatively or in addition the tool holder 11 can have depressions 11B which corresponding engagement elements 2B of the tool 2 can engage.

Figure 5:
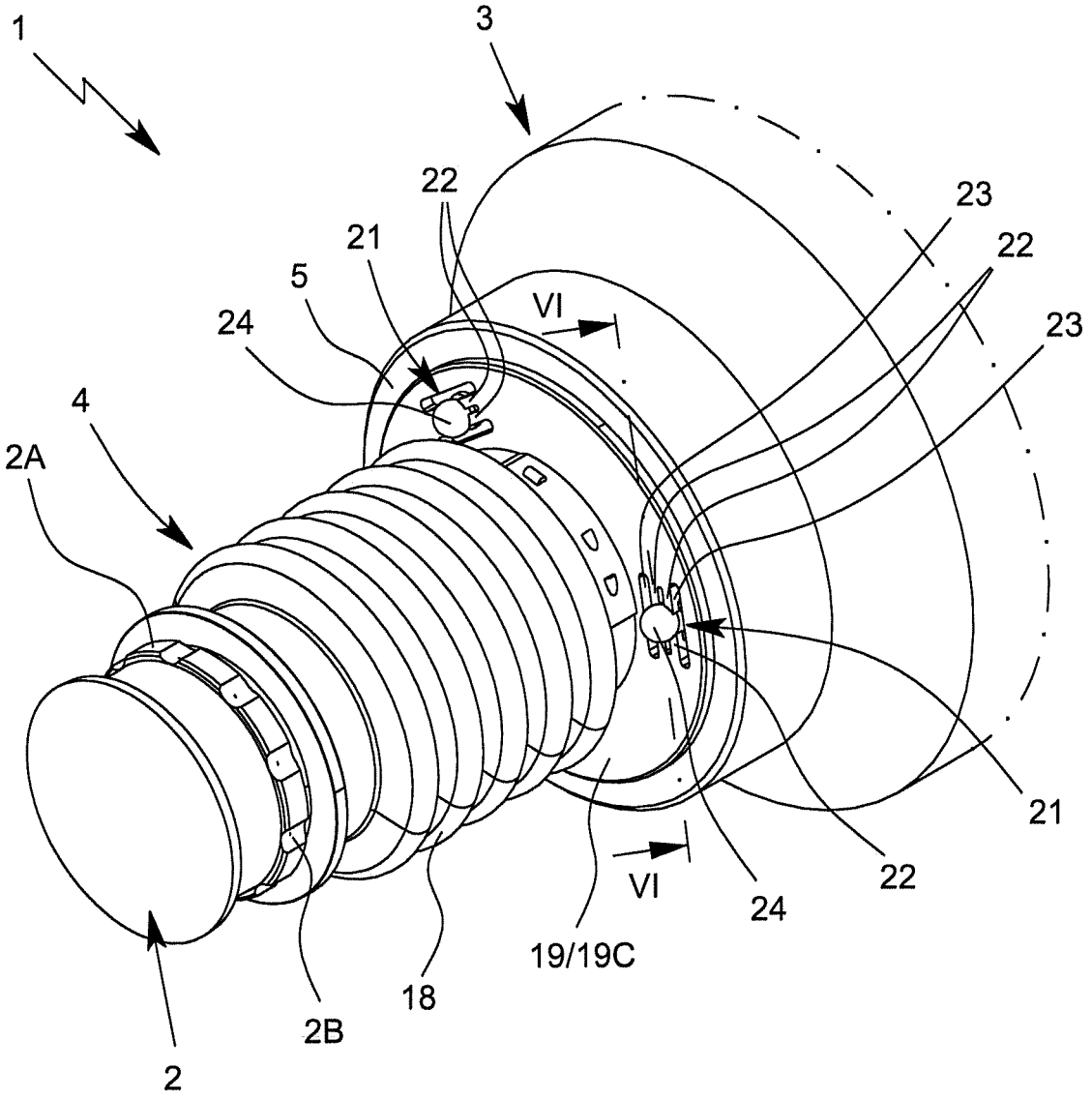
FIG. 5 shows a perspective oblique view of the device with the tool in the region of the tool holding fixture.

In the illustrated example, the tool holder 11 on the peripheral side has projections 11A and depressions 11B alternately which engage with corresponding recesses 2A and engagement elements 2B of the tool 2, as shown in FIG. 5. However, other solutions are also possible here.

Preferably, a form-fit, snap-fit interlocking or latching holding, in particular an axially and/or torsion-resistant or rotatably fixed holding, of the tool 2 on the tool holder 11 or the tool holding fixture 4 is enabled or implemented by the projections 11A and/or depressions 11B or by engagement with them. However, other solutions are also possible here. For example the tool 2 could have flexible arms which accordingly encompass the tool holder 11.

The connecting part 19 preferably has an in particular flange-like retaining portion 19C which is used for fastening to or contact or abutment with the tool drive 3 or head 5.

In particular, the tool holding fixture 4 or the connecting part 19 or the retaining portion 19C is or can be connected or coupled in a torsion-resistant or rotatably fixed manner to the tool drive 3 or head 5 in order to implement the desired torque transfer to the tool holder 11 or the tool 2, here via the connecting part 19 and the bellows 18 to the tool holder 11.

Preferably, the connecting part 19 is made in one piece or is integrally formed and/or is produced from plastic.

The device 1, the tool drive 3 and/or the tool holding fixture 4 preferably has at least one quick connection 21 for the fastening of the tool holding fixture 4 to the tool drive 3, in particular in a manner in which it can be released tool-free, i.e. without using tools.

In the illustrated example the tool holding fixture 4 or the connecting part 19 is or can be attached to the head 5 via at least one quick connection 21. In particular several quick connections 21 are provided here which are distributed over the periphery, in particular of the retaining portion 19C, as indicated in the perspective view according to FIG. 5 which shows the tool-side end of the device 1 with the tool 2 and the tool holding fixture 4.

The preferred structure of a quick connection 21 is detailed below. Preferably, all quick connections 21 are embodied or implemented in the same way, but they can also be embodied differently.

Here "quick connection" means preferably a connection between two parts, in particular between the tool drive 3 on the one hand and the tool holding fixture 4 on the other hand which is in particular interlocking or latching and/or can be released without tools and which for normal operation, therefore for polishing, causes sufficient holding or fastening.

Especially preferably, the quick connection 21 can be established or released by applying an axial force, and/or the quick connection 21 can be formed by axially slipping, clipping, plugging, latching or snapping the tool holding fixture 4 onto the tool drive 3 and/or can be released by axial withdrawal.

To establish or form the or a quick connection 21 preferably one or more quick connection elements are located or formed on the tool drive 3 and/or on the tool holding fixture 4, quick connection elements in particular with the quick connection 21 established are preferably mechanically or magnetically in contact with one another and/or engage one another.

Figure 7:
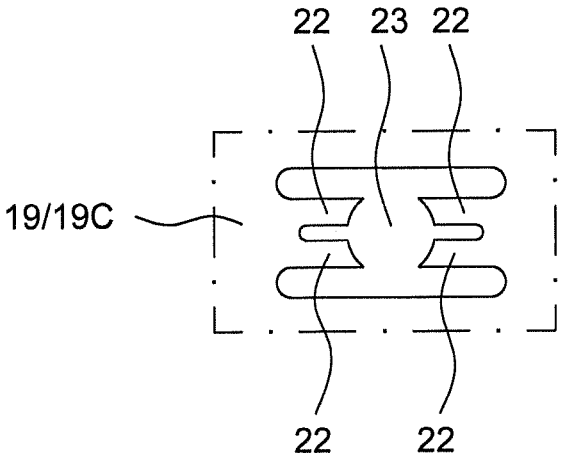
FIG. 7 shows an extract plan view of a connecting part of the tool holding fixture.

In the illustrated example, on the tool holding fixture 4 or on the connecting part 19 or retaining portion 19C at least one spring arm 22 is located or formed as a quick connection element. To form a quick connection 21 preferably several spring arms 22 are provided which protrude here into a recess 23 in particular from opposite sides, in particular in the form of two pairs from opposite sides, as indicated in FIG. 7 which shows by way of extract only the retaining portion 19C of the tool holding fixture 4.

In the illustrated example, preferably at least one connecting section 24 as a quick connection element is located or formed on the tool drive 3 or head 5. The connecting portion 24 here is preferably spherical here and/or it is undercut in the axial direction. Especially preferably the connecting portion 24 is screwed by means of a carrier into or onto the head 5 or attached thereto in some other way.

Figure 6:
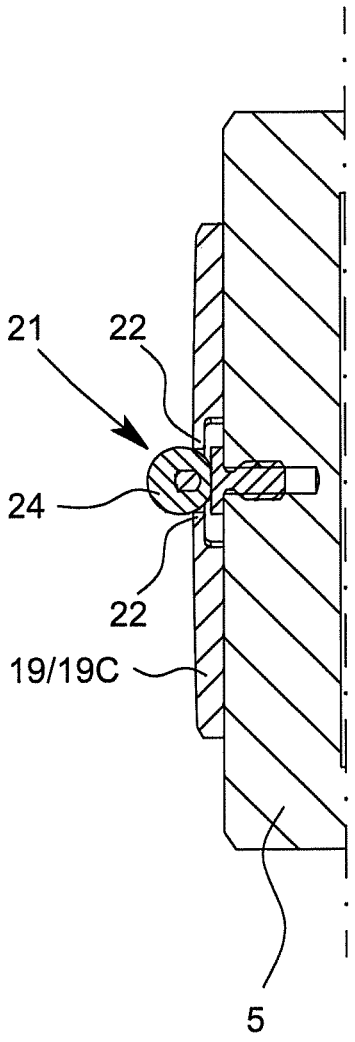
FIG. 6 shows a schematic section along line VI-VI in FIG. 5.

Especially preferably with the quick connection 21 established the connecting portion 24 is encompassed or engaged on the back by one or more spring arms 22 and/or held in the recess 23, as indicated in FIGS. 5 and 6. FIG. 6 shows a section along line VI-VI from FIG. 5 for illustration of the engagement or of the grip on the back with the quick connection 21 established so that the quick connection 21 holds or fixes in particular the tool holding fixture 4 in the axial direction on the tool drive 3.

In the illustrated example, the quick connection elements on the side of the tool holding fixture 4 or the spring arms 22 are preferably integrally formed or molded, in particular onto the connecting part 19 or its retaining portion 19C, or are formed as one piece therewith. However, other structural solutions are also possible.

In the illustrated example, the spring arms 22 run preferably at least essentially in the tangential direction and/or in pairs parallel and/or oppositely, in particular so that the opposing element or the connecting portion 24 with the quick connection 21 established is held or centered preferably in the middle between the free ends of the spring arms 22.

The quick connection 21 is preferably embodied such that mutual centering of the parts to be connected, here of the tool drive 3 relative to the tool holding fixture 4 or of the connecting part 19 relative to the head 5, takes place.

To produce or establish the quick connection 21 (by axial seating or pushing the tool drive 3 and tool holding fixture 4 together) and/or for releasing the quick connection 21 (by axial withdrawal or lifting of the tool holding fixture 4 off the tool drive 3), the spring arms 22 can each give way preferably elastically or resiliently or laterally, in particular to enable movement of the connecting portion 24 into the recess 23 or out of the latter when a corresponding force, acting here in the axial direction, is applied.

The force for releasing the quick connection 21 or all quick connections 21 and/or for establishing the quick connection 21 or all quick connections 21 is preferably greater, in particular by more than 50% or 100%, than the magnetic coupling or retaining force and/or is preferably more than 50 N, in particular more than 20 N, especially preferably more than 80 N.

The quick connection 21 is characterized in particular in that a tool-free establishment and release or a latching or snap connection is implemented. Alternatively or in addition a magnetic connection is also possible. In particular the magnetic coupling or holding of the tool holder 11 or bearing part 12 on the tool drive 3 or positioning element 9 or retaining part 15 can also be regarded or defined as a quick connection 21 in the indicated sense or also as a second or additional quick connection 21. In particular the proposed device 1 then has two different quick connections 21 and/or the tool holding fixture 4 is embodied for producing or establishing two different quick connections 21.

Preferably, the different or all connections 21 or all quick connections 21 can be established and/or released at the same time. Alternatively it is also possible for the different quick connections 21 to be established and/or released only in succession. This is advantageous in that the required forces do not become too high.

The different quick connection elements can also be interchanged among one another and/or replaced or supplemented by other types of elements. For example the spring arms 22 can also be located on the tool drive 3 or head 5 and the connecting portions 24 on the tool holding fixture 4 or on the connecting part 19.

Furthermore there can also be magnetic holding or coupling as a quick connection 21 between the head 5 on the one hand and the tool holding fixture 4 or the connecting part 19 on the other hand.

In the illustrated example, the tool drive 3, head 5 and/or the shaft 7 preferably has a centering portion 25 for centering of the tool holding fixture 4 and/or the connecting part 19. Here the centering portion 25 preferably axially engages the retaining section 19C, the support portion 19A and/or the connecting part 19. However, other structural solutions are also possible.

In the illustrated example, the quick connections 21 are used preferably not only for axial fastening or holding of the tool holding fixture 4, but in particular also for torsion-resistant or rotatably fixed coupling. However, it is also possible to separate the rotary coupling and to embody or use the quick connections 21 only for axial holding or fastening, therefore to implement the rotary coupling independently thereof.

Especially preferably, the force of the magnetic coupling of the tool holder 11 or of the bearing part 12 to the tool drive 3 and/or the axial retaining force of the quick connection(s) 21 is greater than the axial force for releasing the tool 2 from the tool holder 11, in particular by more than 50%, especially preferably by more than 100%. This ensures reliable fastening or holding even if in particular automated release, in particular axial withdrawal or changing of the tools 2, takes place.

The tool holding fixture 4 as an assembly, structural unit or module comprises preferably the tool holder 11, the bearing part 12, the bearing head 13, the bearing element 14, the bellows 18, the connecting part 19, the locking element 20 and/or one or more quick connection elements such as the retaining element 17 and/or spring arms 22.

The bearing head 13 is preferably made of metal and the bearing element 14 is preferably made of plastic so that a preferably lubricant-free tilting bearing is implemented. Such a tilting bearing is however subject to a certain wear, in the same manner as the bellows 18, so that after corresponding use or after corresponding wear, changing or replacing is necessary. This is very easily and quickly possible and in particular tool-free by the proposed embodiment of the tool holding fixture 4 as an assembly, structural unit or module, and/or by the proposed fastening by means of one or more quick connections 21 and/or by magnetic coupling or holding.

Individual aspects and features of this invention can be implemented independently of one another, but also in any combination.

What is claimed is:

1. A tool holding fixture for a tool drive for polishing of optical workpieces by means of a rotatable tool, the tool holding fixture comprising:

a tool holder for holding the tool, a connecting part for fastening to the tool drive, and a bellows fastened to the tool holder and the connecting part;

wherein the tool holder comprises a magnet or magnetizable material for magnetic coupling to an axially adjustable positioning element of the tool drive.

2. The tool holding fixture as claimed in claim 1, wherein the tool holder for holding the tool is tiltable.

3. The tool holding fixture as claimed in claim 1, wherein the tool holder is adapted for latch holding or axial holding of the tool which can be released tool-free.

4. The tool holding fixture as claimed in claim 2, wherein the tool holding fixture has a bearing part which tiltably holds the tool holder.

5. The tool holding fixture as claimed in claim 1, wherein the connecting part of the tool holding fixture can be connected to a head of the tool drive via a quick connection, and a bearing part of the tool holding fixture is connectable to Drill the axially adjustable positioning element of the tool drive.

6. The tool holding fixture as claimed in claim 4, wherein the bearing part is embodied for magnetic coupling to or holding on the axially adjustable positioning element of the tool drive.

7. The tool holding fixture as claimed in claim 1, wherein the bellows is coupled in a torsionally resistant or rotatably fixed manner to the tool holder.

8. The tool holding fixture as claimed in claim 1, wherein the connecting part comprises a flange-shaped retaining portion with one or more quick connection elements for fastening on the tool drive in a manner such that it can be released without tools.

9. The tool holding fixture as claimed in claim 1, wherein the tool holder has projections on the peripheral side which can engage corresponding recesses of the tool for latch holding the tool.

10. A device for polishing of optical workpieces by means of a rotatable tool, comprising:

a tool drive and an interchangeable tool holding fixture for rotating the tool, and the tool drive comprising an axially adjustable positioning element;

the tool holding fixture comprising a tool holder for holding the tool, a connecting part fastened to the tool drive, and a bellows fastened to the tool holder and the connecting part;

wherein the tool holding fixture is magnetically coupled to the axially adjustable positioning element of the tool drive.

11. The device as claimed in claim 10, wherein the connecting part of the tool holding fixture is connected or coupled to a head of the tool drive, in particular via a quick connection, and a bearing part of the tool holding fixture is connected or coupled to the axially adjustable positioning element of the tool drive.

12. The device as claimed in claim 10, wherein the tool drive or its axially adjustable positioning element has a magnet for axial holding of the tool holding fixture or of a bearing part of the tool holding fixture.

13. The device as claimed in claim 10, wherein the magnetic coupling of the tool holding fixture or of the tool holder to the axially adjustable positioning element is greater than the axial force for releasing the tool from the tool holding fixture or the tool holder.

14. A tool holding fixture for a tool drive for polishing of optical workpieces, by means of a rotatable tool, the tool holding fixture comprising:

a tool holder for holding the tool, a connecting part for fastening to the tool drive, and a bellows fastened to the tool holder and the connecting part;

wherein the connecting part comprises a flange-shaped retaining portion with at least one quick connection element for fastening on the tool drive by a quick connection which can be released without using tools.

15. The tool holding fixture as claimed in claim 14, wherein the tool holding fixture has one or more spring arms as quick connection element(s).

16. The tool holding fixture as claimed in claim 14, wherein the tool holding fixture is embodied for establishing several quick connections which are distributed over a periphery.

17. The tool holding fixture as claimed in claim 14, wherein the tool holder is adapted for latch holding or axial holding of the tool which can be released tool-free.

18. The tool holding fixture as claimed in claim 14, wherein the tool holder has projections on a peripheral side which are engageable with corresponding recesses of the tool for latch holding of the tool.

19. A device for polishing of optical workpieces, in particular eyeglass lenses, by means of a rotatable tool, comprising:

a tool drive and an interchangeable tool holding fixture for rotating the tool, wherein the tool drive comprises an axially adjustable positioning element;

wherein the tool holding fixture comprises a tool holder for holding the tool, a connecting part, and a bellows fastened to the tool holder and the connecting part;

wherein the connecting part comprises a flange-like retaining portion with a first quick connection element;

wherein the tool drive comprises a second quick connection element; and wherein the tool holding fixture is interchangeably fastened to the tool drive by means of a quick connection formed by the first quick connection element of the connecting part contacting or by engaging the second quick connection element of the tool drive.

20. The device as claimed in claim 19, wherein the tool holding fixture is interchangeably fastened on the tool drive by means of several quick connections which are distributed over a periphery.

21. The device as claimed in claim 17, wherein the quick connection holds the tool holding fixture by latching and/or can be released by axial withdrawal or by applying an axial force.

22. The device as claimed in claim 17, wherein the quick connection has at least one preferably undercut or spherical connecting portion.

23. The device as claimed in claim 19, wherein the quick connection can be released without tools.

24. The device as claimed in claim 17, wherein the quick connection is embodied such that it opens when an axial force is exceeded.

25. The device as claimed in claim 19, wherein the quick connection produces an axial retaining force that is greater than an axial force for releasing the tool from the tool holding fixture or the tool holder.

26. The device as claimed in claim 19, wherein the tool holding fixture is magnetically coupled to the axially adjustable positioning element of the tool drive.

* * * * *